US006868660B2

(12) United States Patent
Premi

(10) Patent No.: US 6,868,660 B2
(45) Date of Patent: Mar. 22, 2005

(54) DEVICE AND PROCESS FOR THE PNEUMATIC SPLICING OF THREADS OR YARNS CONTAINING AN ELASTOMER OR WITH A HIGH TORQUE

(75) Inventor: Mauro Premi, Salo' (IT)

(73) Assignee: Mesdan S.p.A., Salo'-Brescia (IT)

( * ) Notice: Subject to any disclaimer, the term of this patent is extended or adjusted under 35 U.S.C. 154(b) by 70 days.

(21) Appl. No.: 10/615,132

(22) Filed: Jul. 8, 2003

(65) Prior Publication Data

US 2004/0020182 A1 Feb. 5, 2004

(30) Foreign Application Priority Data

Jul. 9, 2002 (IT) ..... MI2002A1500

(51) Int. Cl.[7] ..... D01H 15/00; B65H 69/06
(52) U.S. Cl. ..... 57/22; 57/202
(58) Field of Search ..... 57/22, 23, 202, 57/261–263; 242/475.1–475.6, 556; 28/141

(56) References Cited

U.S. PATENT DOCUMENTS 5,155,987 A * 10/1992 Vogel ..... 57/22
5,680,751 A * 10/1997 Premi ..... 57/22
5,829,706 A * 11/1998 Schatton et al. ..... 242/475.4
6,209,298 B1 * 4/2001 Tamoto ..... 57/22
2001/0003241 A1 * 6/2001 Premi ..... 57/22
2001/0013160 A1 * 8/2001 Ragnoli et al. ..... 28/271
2002/0174643 A1 * 11/2002 Humml ..... 57/22

* cited by examiner

*Primary Examiner*—John J. Calvert
*Assistant Examiner*—Shaun R Hurley
(74) *Attorney, Agent, or Firm*—Hedman & Costigan, P.C.

(57) ABSTRACT

A process for the pneumatic splicing of threads or yarns containing an elastomer or with a high torque comprises at least the following phases: introduction into a splicing chamber (11, 110) of a splicer (10, 100) of threads (12, 15) to be joined to each other; withholding by friction of the thread-ends (12, 15) by means of friction elements or devices (27, 20, 21) close to or inside the splicing chamber (11, 110); cutting of the thread-ends (12, 15); opening of the thread-ends (12, 15) cut by means of preparation units (22, 23); pulling of the cut and opened thread-ends (12, 15) in the direction of the junction chamber (11, 110); expulsion of the threads and contemporaneous entry of one or more jets of compressed air into the chamber (11, 110) to effect the splicing of the thread-ends (12, 15) and releasing of the spliced thread with the return of all the units of the splicing device (10, 100) to their initial position. The invention also relates to a device for the embodiment of said process.

8 Claims, 6 Drawing Sheets

DEVICE AND PROCESS FOR THE PNEUMATIC SPLICING OF THREADS OR YARNS CONTAINING AN ELASTOMER OR WITH A HIGH TORQUE

The present invention relates to a device and process for the pneumatic splicing of threads or yarns containing an elastomer or with a high torque.

Devices for the compressed air splicing of textile yarns, commonly called air splicers, are already known.

These devices have guides for facilitating the introduction of the threads to be spliced, gripping and cutting units of the threads themselves, preparation units of the ends, pulling units of the cut threads in the direction of the chamber and a chamber situated in a body and equipped with a longitudinal slit for the introduction and extraction of the threads, in which there are one or more adduction holes or nozzles of the compressed air.

In these devices, the splicing of the threads takes place by means of the following operations after introducing the ends of the threads to be joined into the device, and in particular into the splicing chamber, and closing the lid.

The threads are first gripped and cut, the thread-ends are then opened, thus removing the thread torque, by means of compressed air, and are subsequently pulled in the direction of the chamber.

At this point, the threads are partially superimposed next to each other, with their fibres opened and parallel, and are then subjected to one or more jets of compressed air in the splicing chamber to effect the actual splicing by the twisting of the fibres.

Finally, the thread thus spliced is released and all the units of the splicing device return to their initial position.

In this respect, it should be noted that in the last few years, cut fibre threads containing an elastomer, generally consisting of a core made of an elastomeric material covered with a yarn, for example made of cotton, have become widely known on the market.

One of the problems associated with the splicing of threads containing an elastomer, is that when the thread is cut, the elastomer contained in the yarn tends to shrink as a result of its elasticity, which is much higher than the fibres covering it. The splicing therefore normally takes place on a piece of thread deprived of elastomer and the spliced section lacks elasticity and is therefore of a lower quality.

If the yarn has a very high elasticity, moreover, the yarn cut under tension, may, as a result of the retraction elastic force, find itself in an incorrect position for the preparation phase or it may even leave the splicing chamber.

Similar drawbacks occur in the splicing of high torque threads or yarns, which have a particularly nervous and vivacious behaviour, or a so-called memory behaviour, and are therefore difficult to control after the cutting phase.

One of the solutions proposed consists in effecting a first temporary interlacing of the yarns introduced into the chamber parallel to each other, by means of a first entry of air jets, before the cutting phase. The purpose of the temporary interlacing is to keep the yarns in position after cutting the ends. The splicing is then completed by means of a second entry of compressed air jets into the chamber, using the normal pneumatic yarn splicing procedures.

The spliced parts thus obtained however do not have an optimal aesthetic appearance. By effecting the first interlacing of the threads before being cut, and consequently not being able to pull said yarns into the chamber before the definitive splicing, the spliced section is longer and therefore more visible.

Furthermore, a high quality, splicing can only be obtained by interlacing free ends of the yarns which have been untwisted as much as possible.

An objective of the present invention is therefore to provide a device and process which allows a splicing to be obtained, in which the elastomers of the two thread-ends to be spliced are incorporated.

Another objective is to provide a process and device for the splicing of threads or yarns which allows the position of the threads to be accurately controlled during the various process phases.

A further objective of the present invention is to provide a device and process for the pneumatic splicing of threads or yarns containing an elastomer or with a high torque which allows a high quality splicing to be obtained in a particularly simple and functional way, with reduced costs.

These objectives according to the present invention are achieved by means of a process and a device for the pneumatic splicing of threads or yarns containing an elastomer or with a high torque, as illustrated in the independent claims.

Further characteristics of the present invention are also defined in the dependent claims.

The characteristics and advantages of a device and a process for the pneumatic splicing of threads or yarns containing an elastomer or with a high torque according to the present invention will appear more evident from the following illustrative but non-limiting description, referring to the enclosed schematic drawings, in which.

Figure 1:
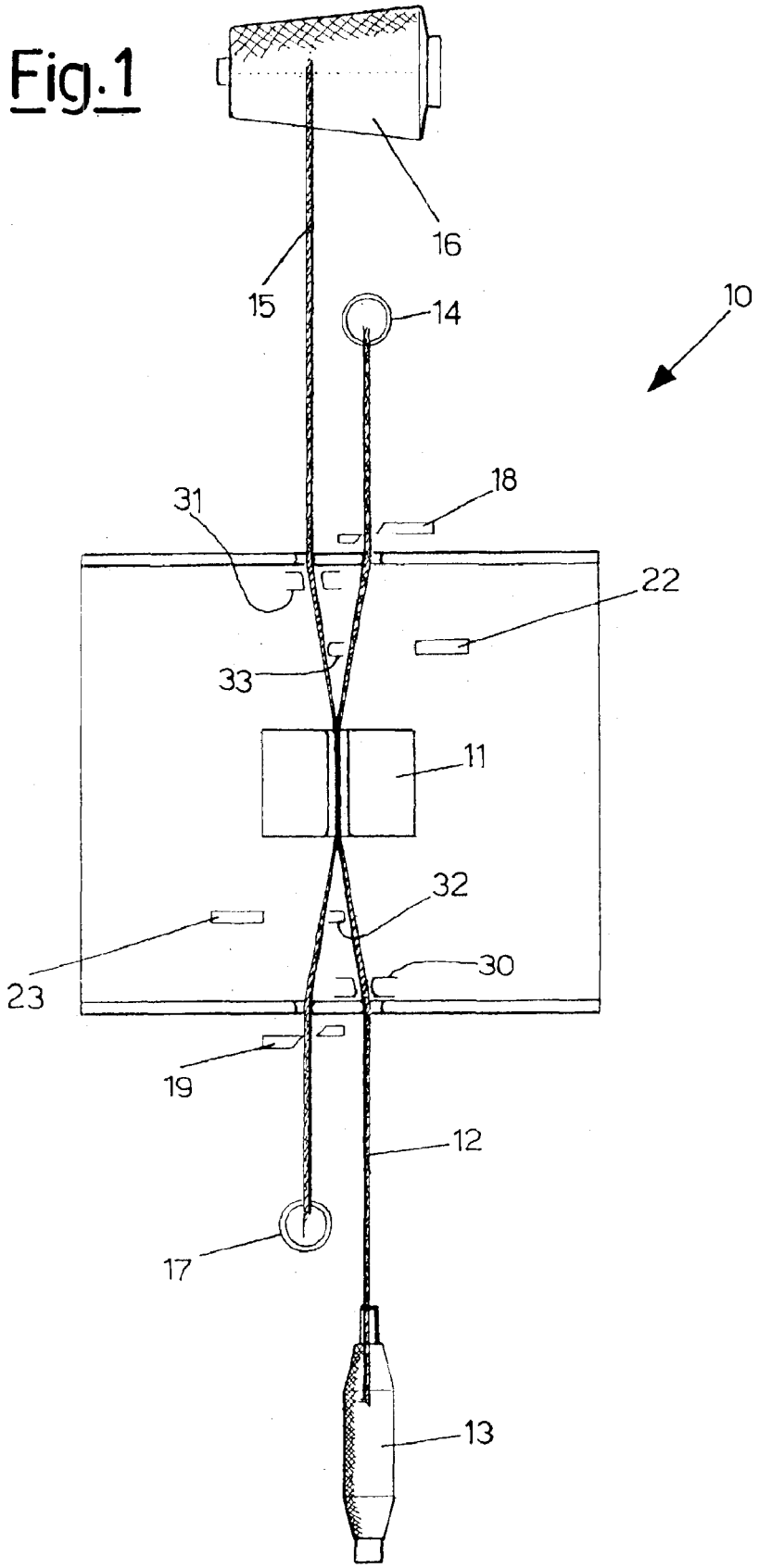
FIG. 1 represents a schematic view of the introduction phase of the threads in a preferred embodiment of a splicer according to a process, object of the present invention.

With reference to FIG. 1, this shows a first preferred embodiment of a device for the pneumatic splicing of threads or yarns containing an elastomer or high torque yarns, according to the present invention, indicated as a whole with 10.

Figure 6:
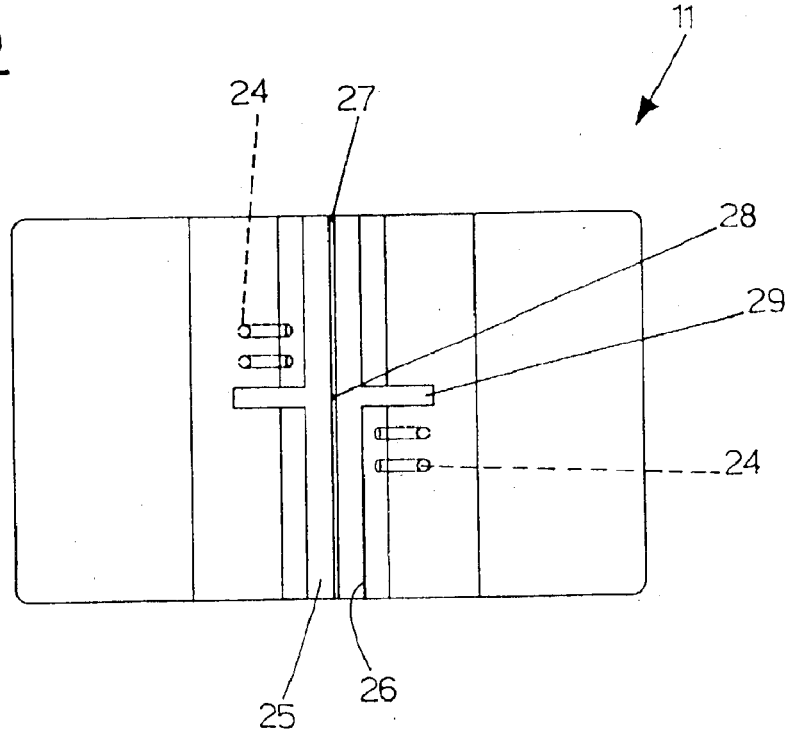
FIG. 6 is a plan view of a splicing chamber of the device of FIG. 1, object of the present invention.
Figure 7:
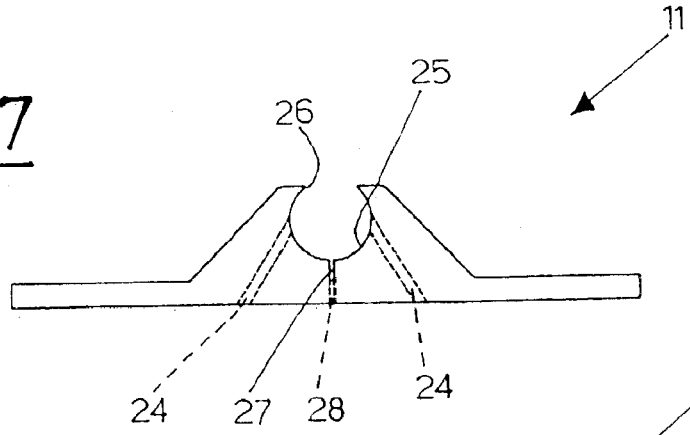
FIG. 7 is a raised side view of the splicing chamber of FIG. 6.
Figure 8:
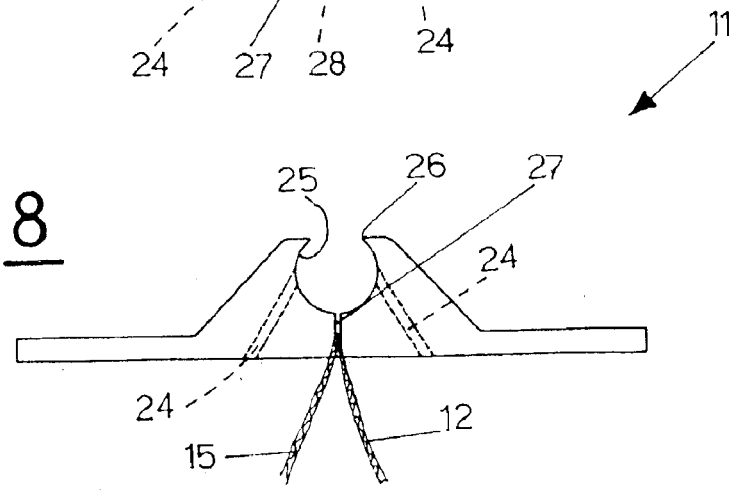
FIG. 8 shows a detail of the threads withheld by friction in the splicing chamber of FIGS. 6 and 7 during the process according to the invention.

In particular, the device 10 has a splicing chamber 11, into which jets of compressed air can be fed through specific nozzles 24, represented in FIGS. 6 to 8.

A first thread 12, coming from a spool 13, is passed through the splicing chamber 11 until it is held in position, at the opposite part of the splicing chamber 11, for example by means of a first suction mouth 14.

Vice versa, a second thread 15, coming from a bobbin 16 is passed through the splicing chamber 11 until it is held in position, at the opposite part of the splicing chamber 11, for example by means of a second suction mouth 17.

The threads 12 and 15, introduced into the splicer 10, are held during all the splicing operations by thread-blocking units situated at the inlet of the device 10, such as clamps 30 and 31. The clamps 30 and 31, initially, open to allow the introduction of the threads 12 and 15 (FIG. 1), subsequently remain closed during the activation of the process according to the invention, as schematized in FIGS. 2 and 3.

FIG. 1 also illustrates cutting units, such as scissors 18 for cutting the tall of the first thread 12 and scissors 19 for cutting the tail of the second thread 15.

Figure 2:
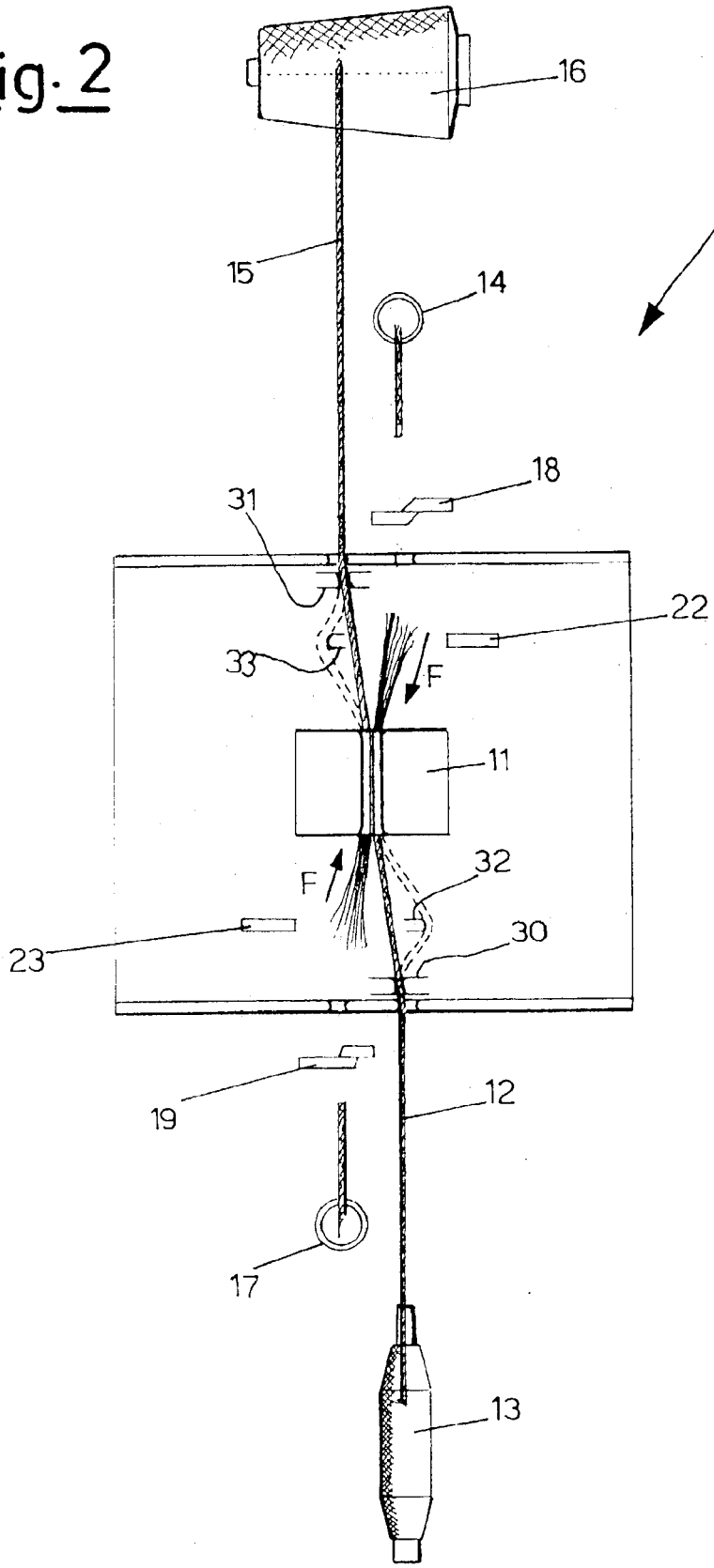
FIG. 2 represents a schematic view of the subsequent cutting and preparation phases of the thread-ends in the device of FIG. 1.
Figure 3:
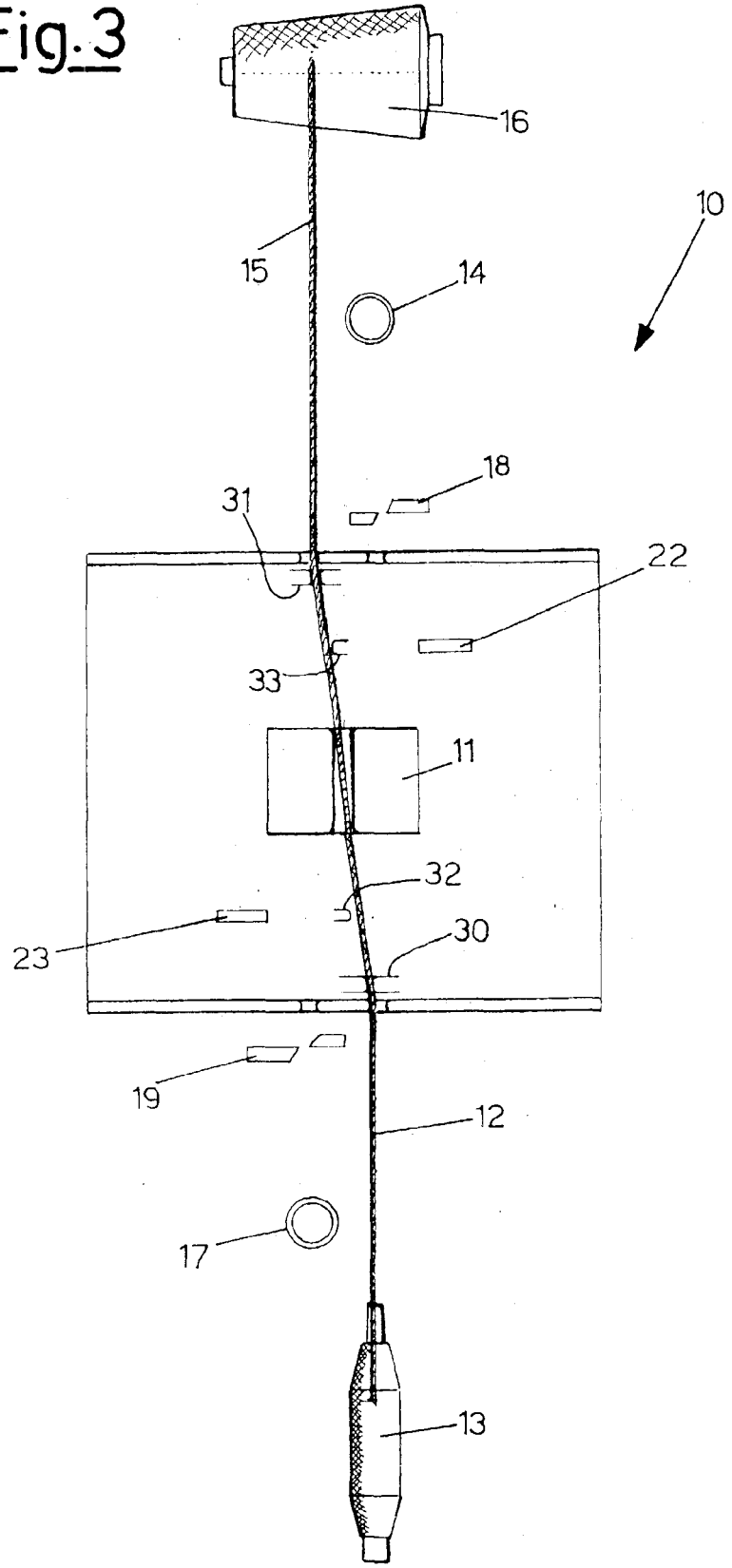
FIG. 3 represents a schematic view of the splicing phase of the thread-ends in the device of FIG. 1.

Pulling levers 32 and 33 of the thread-ends 12 and 15 respectively, are also present and are schematically indicated in FIGS. 1 and 3 in rest position and in FIG. 2 when activated. The levers 32 and 33 intercept the threads 12 and 15 upstream of the splicing chamber 11, as represented in FIG. 2 with a dashed line, to pull the tails of the threads 12 and 15, once cut, in the direction of the arrows F towards the splicing chamber 11.

The gripping of the threads 12 and 15 upstream of the splicing chamber 11 in the clamps 30 and 31 prevents the traction exerted on the threads by the activation of the pulling levers 32 and 33 from also influencing the spool 13 and bobbin 16.

The splicing chamber 11, shown in FIGS. 6 and 7, is equipped with a longitudinal groove 25, for example with a circular section, into which jets of compressed air are fed for the splicing of the yarns by means of holes or nozzles 24, for example arranged in opposite and slanting pairs.

The threads to be spliced are introduced into the groove 25 by means of an upper longitudinal slit 26, which can be closed from above by a lid, not shown.

A friction element is situated on the bottom of the groove 25, which is capable of withholding the threads by friction, consisting of a longitudinal fissure 27 which extends for the whole length of the groove 25, whose width is reduced and in any case less than the depth. The fissure for example, can have a width varying within a range of 0.3 mm to 0.7 mm and a depth of about 1 mm.

These indicative dimensional values can vary according to the type of yarn to be spliced and determine, the correct value of the friction force exerted on the yarns inserted in the fissure 27 (FIG. 8).

The friction element, or fissure 27, does not withhold the yarns in a specific point, but acts on great lengths of the thread 12 and 15, equal to its length.

The friction action exerted by the fissure, which depends on the dimensions and type of yarns, and also on the dimensions of the fissure, must be greater than the elastic strength of the yarns, which are then withheld in the fissure 27 after being cut, but lower than the ultimate tensile strength of the yarns themselves, so that it does not jeopardize the possibility of pulling the yarns in the direction of the splicing chamber 11 by means of a mechanical pulling action without breaking them.

The splicer 10 can also be equipped with devices for the guided insertion of the thread into the groove 25 of the splicing chamber 11 and then into the fissure 27, for example consisting of slanting plates, assembled close to the ends of the groove, not shown in the figures.

On the bottom of the fissure 27, there is at least one channel 28, for the entry at suitable intervals of a jet of compressed air for the expulsion of the threads 12 and 15 from the fissure 27.

In order to facilitate the discharge of the air introduced into the splicing chamber 11 through the nozzles 24 and also through the channel 28, this can have a central transversal slit 29, shown in FIG. 6.

Furthermore, the units 22 and 23 for the preparation of the cut thread-ends are schematically represented in the figures. The preparation units 22 and 23, which create, for example, a depression to untwist the fibres of the yarns to be spliced, are activated at the moment of the cutting of the thread-ends 12 and 15. In particular, in the case of elastic or high torque yarns, said units 22 and 23 are activated slightly in advance with respect to the cutting units to intervene immediately on the fibres, which are marked by a particularly nervous and vivacious behaviour.

With reference to FIGS. 1 to 3, the operating sequence relating to a first preferred embodiment of the process of the invention is as follows: first of all, the ends of the threads 12 and 15 to be spliced are introduced into the device 10, and then into the splicing chamber 11. In particular, the threads 12 and 15 are introduced into the friction element, the fissure 27, which withholds them by friction (FIGS. 1 and 8).

The following phases are subsequently effected in succession: the ends of the threads 12 and 15 are cut, still subjected to friction in the fissure 27, and the cut ends are opened by means of the preparation units of the ends 22 and 23 (FIG. 2). The great elasticity typical of this kind of yarn causes an enlargement of the section of yarns after cutting and consequently an increase in the friction between them inside the fissure 27.

The thread-ends 12 and 15, still inserted in the friction element 27, are then pulled in the direction of the arrows F towards the splicing chamber 11 by the action of the pulling levers 32 and 33 (FIG. 2).

The threads 12 and 15 are subsequently expelled from the fissure 27 by a vent of air fed directly into the fissure 27 through the channel 28 and contemporaneously with one or more jets of compressed air, sent into the chamber through the nozzles 24, the splicing of the cut and untwisted ends is effected, according to what is schematically illustrated in FIG. 3.

Finally, the spliced thread is released and all the units of the device return to their initial position.

Figure 4:
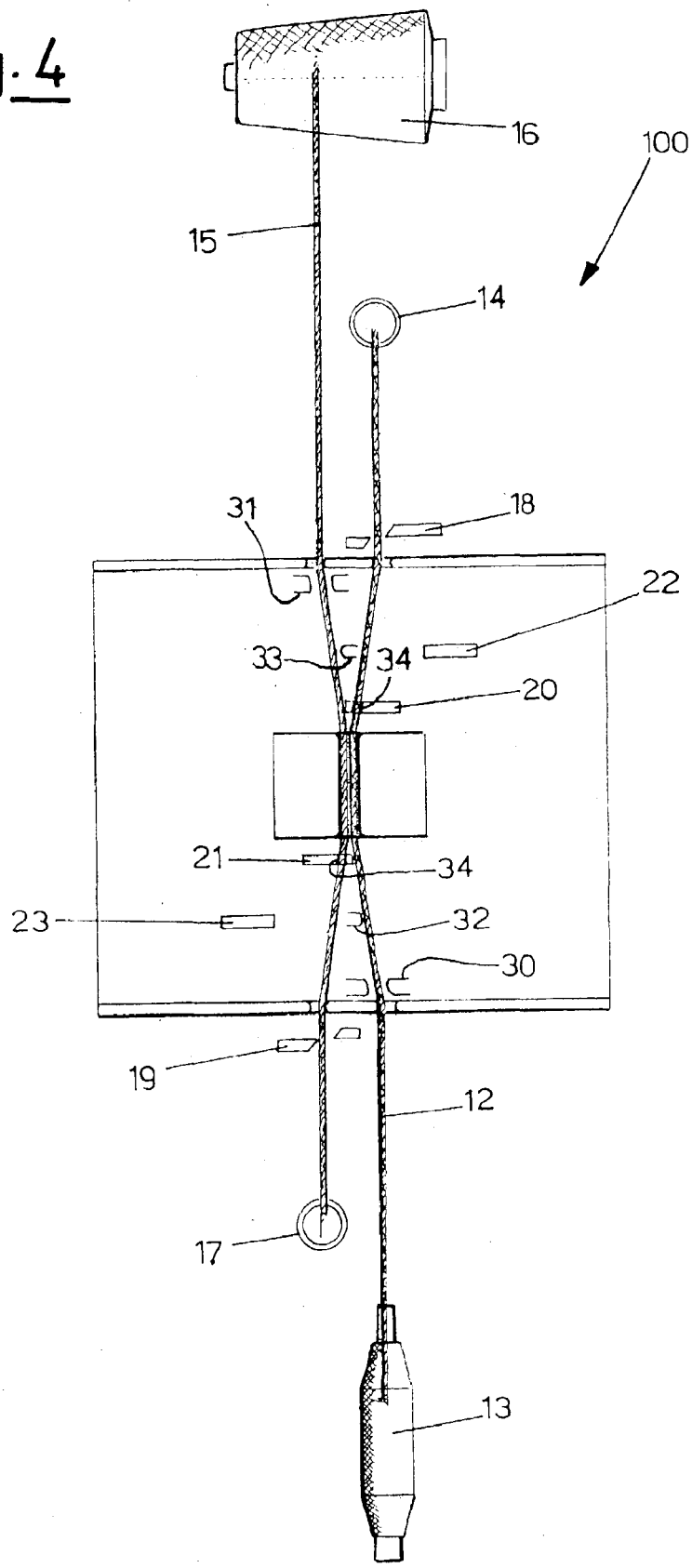
FIG. 4 represents a schematic view of the introduction phase of the threads in a second embodiment of a splicer according to a process, object of the present invention.

FIG. 4 shows a schematic view of a second embodiment of the splicer according to the invention, indicated as a whole with 100 and equipped with a splicing chamber 110 of the known type, into which jets of compressed air can be fed through nozzles not illustrated.

In addition to what is described with respect to the first embodiment of the splicer 10, there are also friction devices 20 and 21, capable of withholding the threads 12 and 15 by friction, situated close to the splicing chamber 110 immediately upstream thereof and in particular between the preparation units 22 and 23 and the chamber itself 110.

The friction devices 20 and 21 consist, for example, of fixed units equipped with a fissure 34 for the insertion of the thread-ends 12 and 15 to be cut, analogously to what is described for the first embodiment of the splicing chamber 11. The fissure 34 can have a width varying within a range of 0.3 mm to 0.7 mm and a depth of about 1 mm, or it can also have smaller dimensions if only one thread is housed.

Figure 5:
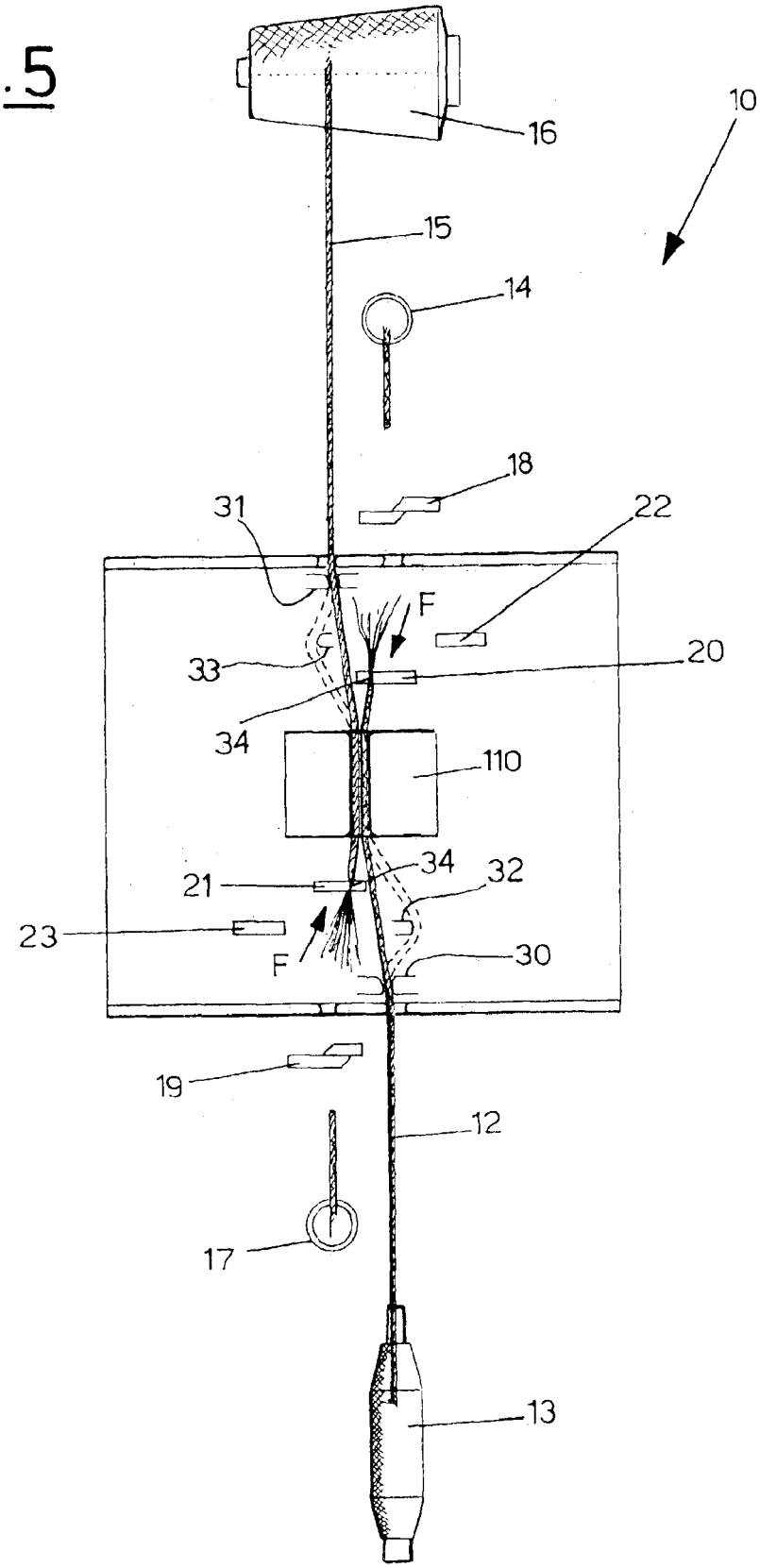
FIG. 5 represents a schematic view of the subsequent cutting and preparation phases of the thread-ends in the device of FIG. 4.

The operating sequence relating to this second embodiment of the process according to the invention, schematized in FIGS. 4 and 5, comprises the introduction of the thread-ends 12 and 15 into the splicing chamber 110 of the device 100 and in particular into the friction devices 20 and 21 and their blockage at the inlet of the splicer 100 by means of the clamps 30 and 31.

At this point, the thread-ends 12 and 15 are cut, which, as a result of the friction exerted in the fissure 34, are not pulled beyond the preparation units 22 and 23 of the thread-ends. An opening of the thread-ends is subsequently effected by means of the preparation units 22 and 23 causing them to untwist (FIG. 5).

The thread-ends 12 and 15, are then pulled by the levers 32 and 33 in the direction of the arrows F towards the splicing chamber 110, where the thread-ends are spliced with one or more jets of compressed air, according to the known technique which is therefore not illustrated.

The definite expulsion of the threads 12 and 15 from the friction elements 20 and 21 is obtained by means of the turbulence caused by the compressed air which enters the chamber 110 during the splicing phase, not shown.

Finally, the spliced thread is released and all the units of the device return to their initial position.

The friction elements 20 and 21 can also receive both of the threads inside the fissure 34, i.e. the tail of the thread 12 and the thread 15 at the inlet of the device 100, as well as the tail of the thread 15 and the thread 12 at the inlet of the device 100, respectively.

Another embodiment of the friction elements 20 and 21 can comprise two distinct fissures, one for each of the threads 12 and 15.

Furthermore, a technical equivalent of the friction elements 20 and 21 can consist in the use of mobile mechanical means, such as clamps, for example, activated before the cutting phase and slackened before the threads are pulled towards the splicing chamber.

The activation of the process according to the invention advantageously allows an excellent control of the position of the threads in the splicing chamber by means of the friction exerted by the two threads inside the friction elements.

The addition of a friction phase, i.e. withholding of the yarns by friction, near the splicing chamber or inside the splicing chamber itself before the cutting of the ends and a pulling phase of the untwisted yarn ends inside the splicing chamber, advantageously allows a high quality splicing to be obtained.

Finally, numerous variations can obviously be applied to the device and process, object of the present invention, without deviating from the novelty principles forming part of the inventive concept.

In the practical embodiment of the invention, the materials, forms and dimensions of the details illustrated can vary according to the specific demands and can be substituted with other technical equivalents.

What is claimed is:

1. A process for the pneumatic splicing of threads or yarns containing an elastomer or with a high torque, characterized in that it comprises at least the following phases, in succession: introduction into a splicing chamber (11, 110) belonging to a splicer (10, 100) of thread-ends (12, 15) to be joined to each other; withholding by friction of the thread-ends (12, 15) by means of friction elements or devices (27, 20, 21) close to or inside the splicing chamber (11, 110); cutting of the thread-ends (12, 15) by means of cutting devices (18, 19); opening of said thread-ends (12, 15) cut by means of preparation units (22, 23); pulling of said cut and opened thread-ends (12, 15) in the direction of said junction chamber (11, 110) according to the arrows (F); expulsion of said threads (12, 15) from said friction elements (27, 20, 21) and contemporaneous entry of one or more jets of compressed air into the above chamber (11, 110) to effect the splicing of said thread-ends (12, 15) and releasing of the spliced thread with the return of all the units of the splicer (10, 100) to their initial position.

2. The process according to claim 1, characterized in that said withholding phase by friction of said thread-ends (12, 15) inside said splicing chamber (11) is effected by the insertion of said threads (12, 15) into a longitudinal fissure (27), or friction element, present on the bottom of a groove (25) of said splicing chamber (11).

3. The process according to claim 2, characterized in that said thread-ends (12, 15) are expelled from said fissure (27) by the entry of compressed air into said fissure (27) through a channel (28) contemporaneously with said splicing phase.

4. The process according to claim 1, characterized in that said withholding phase by friction of said thread-ends (12, 15) close to said splicing chamber (110), comprises the use of friction elements (20, 21) equipped with a longitudinal fissure (34) and situated upstream of said splicing chamber (11) and downstream of said preparation units (22, 23).

5. A device for the pneumatic splicing of threads or yarns containing an elastomer, comprising a splicing chamber (11), equipped with a longitudinal groove (25) for the insertion of thread-ends (12, 15) to be spliced in which there are one or more adduction nozzles of compressed air (24), and cutting devices (18, 19) of said threads (12, 15), characterized in that said longitudinal groove (25) of said splicing chamber (11) is equipped on the bottom with a longitudinal fissure (27), or friction element, which extends for the whole length of said groove (25) for withholding said threads (12, 15) by friction and equipped with a channel (28) for the entry of compressed air into said fissure (27) for the expulsion of said threads (12, 15).

6. The device according to claim 5, characterized in that said fissure (27) has a width less than its depth.

7. The device according to claim 5, characterized in that said fissure (27) has a width ranging from 0.3 mm to 0.7 mm.

8. The device according to claim 5, characterized in that said fissure (27) has a depth equal to at least 1 mm.

* * * * *